US006079947A

United States Patent [19]

Gabriel et al.

[11] Patent Number: 6,079,947

[45] **Date of Patent: *Jun. 27, 2000**

[54] FAN BLADE APPLIQUE

[76] Inventors: Francis Gabriel, 5032 Hudson Dr., Plano, Tex. 75093-5079; David Meermans, 2045 Cumberland Trail, Plano, Tex. 75023

[ * ] Notice: Under 35 U.S.C. 154(b), the term of this patent shall be extended for 250 days.

[21] Appl. No.: 08/611,725

[22] Filed: Mar. 6, 1996

[51] Int. Cl.[7] ..... F04D 29/38

[52] U.S. Cl. ..... 416/229 R; 416/5; 416/62; 416/146 R

[58] Field of Search ..... 416/5, 61, 62, 416/146 R, 204 R, 205, 210 R, 229 R; D23/370, 377, 379, 385, 413

[56] References Cited

U.S. PATENT DOCUMENTS

| | | | |
|---|---|---|---|
| D. 271,933 | 12/1983 | Miska | D7/39 |
| D. 275,686 | 9/1984 | Beasley | D17/20 |
| D. 296,642 | 7/1988 | Gill | D7/39 |
| D. 343,419 | 1/1994 | Pearce | D20/11 |
| D. 343,866 | 2/1994 | Pearce | D20/11 |
| D. 344,103 | 2/1994 | Pearce | D20/11 |
| 1,958,792 | 5/1934 | Kubin | 41/33 |
| 2,311,156 | 2/1943 | Casto | 18/61 |
| 2,701,540 | 2/1955 | Hamilton | 416/5 |
| 2,720,013 | 10/1955 | Clarke | 416/62 |
| 2,889,233 | 6/1959 | Steffey | 117/3.1 |
| 3,067,054 | 12/1962 | Reese | 117/3.4 |
| 3,147,811 | 9/1964 | Kionoski | 416/210 R |
| 3,288,359 | 11/1966 | Sampson | 416/5 |
| 3,757,730 | 9/1973 | Douglas | 415/52 |
| 4,333,781 | 6/1982 | Meuienberg | 156/152 |
| 4,676,721 | 6/1987 | Hardee | 416/5 |
| 4,678,690 | 7/1987 | Palmer et al. | 428/31 |
| 4,753,573 | 6/1988 | McKnight | 416/62 |
| 4,832,572 | 5/1989 | Prucha et al. | 416/5 |
| 5,021,275 | 6/1991 | Kim | 428/42 |
| 5,033,113 | 7/1991 | Wang | 416/5 |
| 5,073,423 | 12/1991 | Johnson et al. | 428/40 |
| 5,110,261 | 5/1992 | Junkin | 416/5 |
| 5,224,830 | 7/1993 | Wang | 416/5 |
| 5,343,648 | 9/1994 | Bracken | 40/638 |
| 5,370,721 | 12/1994 | Carnahan | 416/62 |
| 5,470,205 | 11/1995 | Conklin, Jr. | 416/229 R |

FOREIGN PATENT DOCUMENTS

| | | | |
|---|---|---|---|
| 0326684 | 2/1958 | Switzerland | 416/210 R |

*Primary Examiner*—Christopher Verdier
*Attorney, Agent, or Firm*—Sidley & Austin

[57] ABSTRACT

An ceiling fan applique and method for adorning the blades of a ceiling fan. An applique constructed of a thin, flexible material includes printed matter disposed on a front surface of the applique. Pressure sensitive adhesive is mounted to the rear surface of the applique. The applique has a predetermined shape substantially corresponding to the shape of the ceiling fan blade. A release liner is affixed to the rear surface of the applique to prevent the applique from becoming inadvertently affixed or damaged prior to intended use.

21 Claims, 2 Drawing Sheets

FAN BLADE APPLIQUE

TECHNICAL FIELD OF THE INVENTION

This invention relates to a decorative product for ceiling fan blades, and in particular to a removable applique designed to adhere to and adorn the visible surface of a ceiling fan blade.

BACKGROUND OF THE INVENTION

Ceiling fans are well known and are popular decorative and functional devices used in residential buildings as well as commercial facilities, such as restaurants and bars. However, heretofore, there has been no ready means to decorate the ceiling fan blades which are a prominent feature of the fan. Most available ceiling fans have blades constructed of wood or plastic materials. The finish on the blades is either a wood stain finish or a painted finish.

It is desirable to have a simple means of adding decoration to ceiling fans. For example, decorated ceiling fan blades may provide a theme to a room in which the ceiling fan is located. As another example, the ceiling fan blades of a ceiling fan in a restaurant provide usable and visible space for advertising products and services. By providing a removable and simple device to be applied to the visible surface of the ceiling fan blades, this space can be used for advertisement. The present invention provides such a simple, removable means of adding decoration to the visible surface of a ceiling fan blade.

SUMMARY OF THE INVENTION

The present invention relates to an applique designed for attachment to the blades of a ceiling fan and a method of adorning a ceiling fan using the applique. The applique of the present invention is constructed of a flexible material having a front surface and a rear surface. The front surface of the applique has printed matter thereon. The rear surface of the applique is coated with a pressure sensitive adhesive. Preferably, the adhesive is such that the applique can be readily removed from the fan blade without damaging the finish on the fan blade.

The applique of the present invention has a predetermined shape substantially corresponding to the shape of the ceiling fan blade. A release liner is affixed to the rear surface of the applique to prevent the applique from becoming inadvertently affixed or damaged prior to intended use. In use, the liner is removed from the applique and the applique is affixed to a ceiling fan blade by centering the applique on the blade.

In a preferred embodiment of the invention, the applique is constructed of a polyester material. The applique also can be laminated with a protective material in order to improve durability and appearance.

BRIEF DESCRIPTION OF THE DRAWINGS

For a more complete understanding of the present invention, and for further advantages thereof, reference is now made to the following description, taken in conjunction with the accompanying drawings, in which.

DETAILED DESCRIPTION

Figure 1:
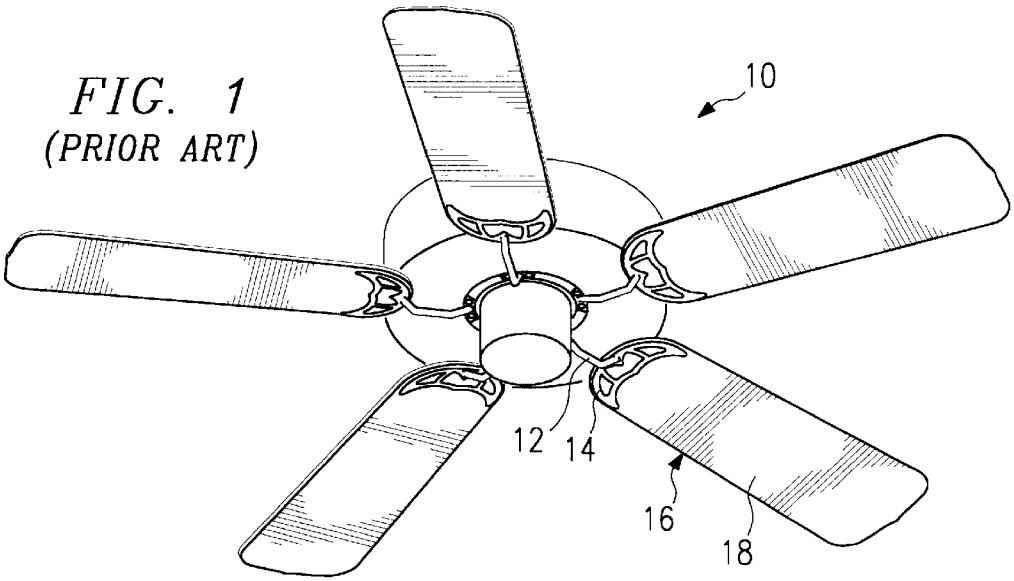
FIG. 1 (PRIOR ART)
FIG. 1 is a perspective view of a conventional ceiling fan.

With reference now to the accompanying drawings, wherein like or corresponding parts are designated by the same reference numeral, various embodiments of the present invention will be described.

Referring to FIG. 1, there is shown a typical ceiling fan 10. Ceiling fan 10 includes a drive means (not shown) operably connected to radial arms 12 and provides the rotational movement to radial arms 12. Each of the radial arms 12 include a bracket 14 at the distal ends of each of the radial arms 12. The brackets 14 are often decorative in shape and design, however, as used herein a bracket is broadly defined as the portion of the radial arm where the fan blade is attached to the radial arm. Ceiling fan blades 16 are operably connected to ceiling fan 10 at brackets 14. The applique of the present invention is intended to be adhered to the downwardly facing surface 18 (herein also referred to as the visible surface) of the ceiling fan blades.

Figure 2:
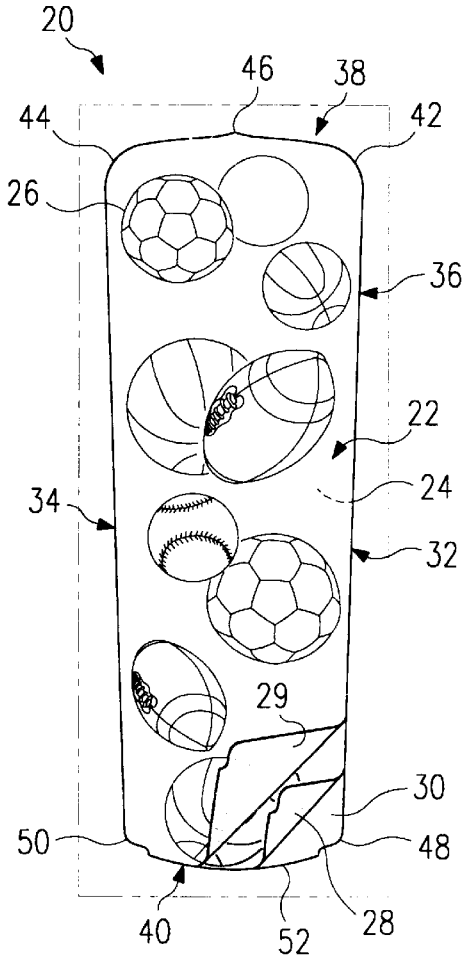
FIG. 2 is a perspective view of a ceiling fan blade applique of the present invention.

With reference to FIG. 2, a ceiling fan blade applique of the present invention is generally identified by reference numeral 20. Applique 20 has a front surface 22 and a rear surface 24. Front surface 22 of applique 20 contains printed matter 26. Printed matter 26 can be of any type and color. For example, the printed matter can consist of a colorful decorative theme, such as the sports theme shown in FIG. 2. Printed matter 26 can also be informational in nature, such as advertising for a particular product or services. Any of various known printing techniques can be used to apply the printed matter to the applique.

Rear surface 24 of applique 20 has a pressure sensitive adhesive 28 mounted thereon. Any known pressure sensitive adhesive, permanent or repositional, may be used in conjunction with the present invention. Preferably, the pressure sensitive adhesive should be of a type which does not damage the finish on the ceiling fan blade to which it is applied and which may be readily removed from the ceiling fan blade. A preferred pressure sensitive adhesive which is particularly desirable for use with the present invention is FASSON R128.

Applique 20 can be constructed of any thin, flexible material suitable for receiving printed matter. In a preferred embodiment, applique 20 is constructed of a thin plastic material such as polyester. The applique may also be constructed of a paper material, although less durable than plastic. To provide improved durability and finish, the applique can be laminated with any suitable thin, transparent material 29, for example, MYLAR polyester film.

Applied over the pressure sensitive adhesive 28 is a release liner 30 (FIG. 2). Release liner 30 prevents adhesive 28 from binding to any surface prematurely. Release liner 30 can be constructed of any suitable material for this purpose. Preferably, release liner 30 is constructed of a silicon-coated paper material. Sixty pound (60#) craft silicone coated liner has been found to be very suitable.

Figure 3:
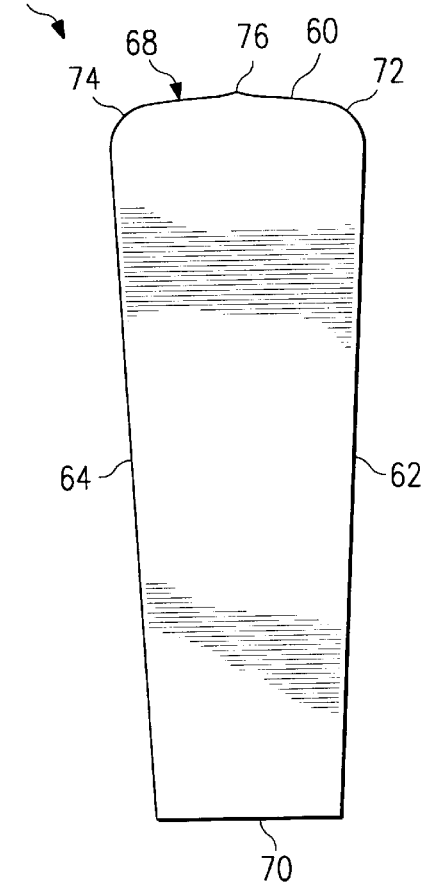
FIG. 3 is a perspective view of a ceiling fan blade applique incorporating a second embodiment of the present invention.
Figure 4:
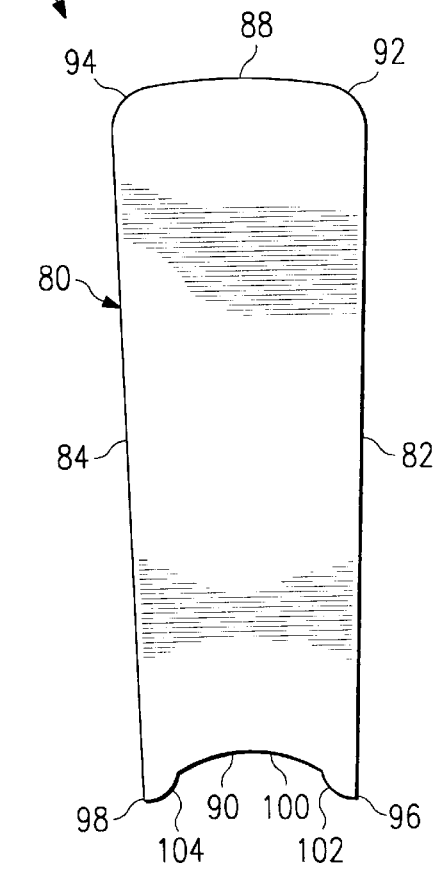
FIG. 4 is a perspective view of a ceiling fan blade applique incorporating a third embodiment of the present invention.

The shape of applique 20 substantially corresponds to the shape of the visible surface of a ceiling fan blade. FIGS. 2, 3 and 4 depict the most common ceiling fan blade shape and, hence, the preferred shapes of the applique of the present invention. While it is preferable that the size of the blade-shaped applique is such that it covers substantially all of the ceiling fan blade, the applique may be scaled down. For example, the blade-shaped applique may be proportionally scaled down to 70% of the size of the ceiling fan blade surface. When centered on the ceiling fan blade, the visible portion of the blade surface creates a border effect around the applique.

With reference to FIG. 2, the shape or periphery 36 of applique 20 is defined by a first side edge 32, a second side edge 34, distal end 38 and proximal edge 40, and first side edge 32 and second side edge 34 are substantially straight and slightly taper toward proximal edge 40. Distal edge 38 curves to meet first side edge 32 and second side edge 34 at points 42 and 44, respectively. At the approximate center of distal edge 38, distal edge 38 rises to a point 46. Proximal edge 40 joins with first side edge 32 and second side edge 34 along curved portions 48 and 50, respectively. Arch portion 52 of proximal edge 40 spans and connects curved portions 48 and 50 to form proximal edge 40. In short, the shape of proximal edge 40 is determined by the shape of the bracket which connects the ceiling fan blade to the ceiling fan.

With reference to FIG. 3, the shape of a second embodiment of applique 20 is shown. The shape or periphery 60 of applique 20 is defined by a first side edge 62, a second side edge 64, distal end 68 and proximal edge 70. First side edge 62 and second side edge 64 are substantially straight and slightly taper toward proximal edge 70. Distal edge 68 curves to meet first side edge 62 and second side edge 64 at points 72 and 74, respectively. At the approximate center of distal edge 68, distal edge 68 rises to a point 76. Proximal edge 70 is substantially straight. Proximal edge 70 joins with and is approximately perpendicular to first side edge 62 and second side edge 64, deviating from perpendicular only by the slight taper of the side edges. Again, the shape of proximal edge 70 is determined by the shape of the bracket which connects the ceiling fan blade to the ceiling fan.

With reference to FIG. 4, the shape of a third embodiment of applique 20 is shown. The shape or periphery 80 of applique 20 is defined by a first side edge 82, a second side edge 84, distal end 88 and proximal edge 90. First side edge 82 and second side edge 84 are substantially straight and slightly taper toward proximal edge 90. Distal edge 88 is an elongated "C" shape and curves to meet first side edge 82 and second side edge 84 at points 92 and 94, respectively. Proximal edge 90 joins with first side edge 82 and second side edge 84 at points 96 and 98, respectively. Inverted arch portion 100 of proximal edge 90 spans and connects curved portions 102 and 104 to form proximal edge 90. Again, the shape of proximal edge 90 is determined by the shape of the bracket which connects the ceiling fan blade to the ceiling fan.

Figure 5:
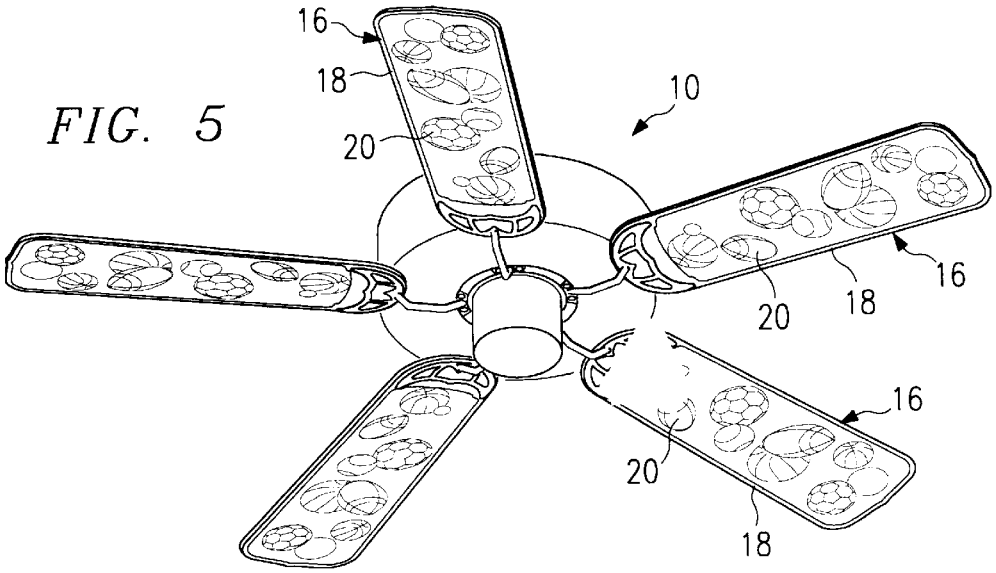
FIG. 5 is a perspective view of a ceiling fan having the applique of the present invention applied to the fan blades.

As shown in FIG. 5, the applique 20 of the present invention is affixed to the downwardly facing, visible surface 18 of a ceiling fan blade 16. Because the applique corresponds to the shape of the ceiling fan blade it can be affixed to the fan blade such that substantially the entire visible surface of the fan blade is covered in the case of an applique which is not scaled down. Further, in the case where the applique of the present invention is scaled down (with respect to the size of the ceiling fan blade) by centering the applique on the ceiling fan blade a border effect is created by the visible portion of the ceiling fan blade surface (FIG. 5).

Although the present invention has been described with respect to a preferred embodiment, various changes, substitutions and modifications of this invention may be suggested to one skilled in the art, and it is intended that the present invention encompass such changes, substitutions and modifications as fall within the scope of the appended claims.

What is claimed is:

1. In a decorative applique for a ceiling fan, said ceiling fan having a plurality of radial arms, each including a bracket, and a fan blade extending outwardly from each said radial arm and attached to each said radial arm at said bracket, said fan blades having a downwardly facing, visible surface, said applique comprising:

a flexible material having a front surface and a rear surface; said front surface having printed matter thereon; said rear surface having a pressure sensitive adhesive material coated thereon;

said applique having a predetermined shape substantially corresponding to said downwardly facing, visible surface of at least one of said fan blades; and said pressure sensitive adhesive being such that said applique can be applied to and removed from at least one of said ceiling fan blades without causing damage to said surface of said ceiling fan blade.

2. The applique as defined in claim 1 further comprising a liner releasably attached to said adhesive-coated rear surface of said flexible material, whereby said applique can be removed from said liner for attachment of said applique to said at least one of said ceiling fan blades.

3. The applique as defined in claim 1 further comprising a liner releasably attached to said adhesive-coated rear surface of said flexible material, whereby said applique can be removed from said liner for attachment of said applique to said at least one of said ceiling fan blades.

4. The applique as defined in claim 1 wherein said applique is laminated with a protective material.

5. The applique as defined in claim 1 wherein said flexible material is a polyester material.

6. The applique as defined in claim 1 wherein said applique has a periphery defined by a first side edge, a second side edge, a distal end and a proximal edge, said first side edge and said second side edge being substantially straight and tapering toward said proximal edge, said distal edge being curved to meet said first side edge and said second side edge, said distal edge further including a pointed portion at the approximate center of said distal edge and said proximal edge having a curved portion meeting with said first side edge and said second side edge, respectively.

7. The applique as defined in claim 1 wherein said applique has a periphery defined by a first side edge, a second side edge, a distal end and a proximal edge, said first side edge and second side edge being substantially straight and tapered toward said proximal edge, said distal edge having curved portions meeting with said first side edge and said second side edge, respectively, said distal edge having a pointed portion at the approximate center thereof, and said proximal edge being substantially straight and adjoining said first and second side edges at substantially perpendicular angles, respectively.

8. The applique as defined in claim 1 wherein said applique has a periphery defined by a first side edge, a second side edge, a distal edge and a proximal edge, said first side edge and said second side edge being substantially straight and tapered toward said proximal edge, said distal edge having a C-shape, said distal edge being adjoined to said first side edge and said second side edge, said proximal edge having a portion which is arched toward said distal edge and said proximal edge being adjoined to said first side edge and said second side edge.

9. A ceiling fan having a plurality of radial arms, each including a bracket, and a fan blade extending outwardly from each said radial arm and attached to each said radial arm at said bracket, said fan blades having a downwardly facing, visible surface, said ceiling fan further having at least one applique, said applique comprising a flexible material having a front surface and a rear surface, said front surface having printed matter thereon, said rear surface having a pressure sensitive adhesive material coated for adhesion to said downwardly facing surface of at least one of said fan blades, said pressure sensitive adhesive being such that said applique can be applied to and removed from said at least one of said ceiling fan blades without causing damage to said surface of said ceiling fan blade, and said applique having a predetermined shape substantially corresponding to said downwardly facing, visible surface of said fan blade.

10. The ceiling fan as defined in claim 9 wherein said applique is laminated with a protective material.

11. The ceiling fan as defined in claim 9 wherein said flexible material is a polyester material.

12. The ceiling fan as defined in claim 9 wherein said applique has a periphery defined by a first side edge, a second side edge, a distal end and a proximal edge, said first side edge and said second side edge being substantially straight and tapering toward said proximal edge, said distal edge being curved to meet said first side edge and said second side edge, said distal edge further including a pointed portion at the approximate center of said distal edge and said proximal edge having a curved portion meeting with said first side edge and said second side edge, respectively.

13. The ceiling fan as defined in claim 9 wherein said applique has a periphery defined by a first side edge, a second side edge, a distal end and a proximal edge, said first side edge and second side edge being substantially straight and tapered toward said proximal edge, said distal edge having curved portions meeting with said first side edge and said second side edge, respectively, said distal edge having a pointed portion at the approximate center thereof, and said proximal edge being substantially straight and adjoining said first and second side edges at substantially perpendicular angles, respectively.

14. The ceiling fan as defined in claim 9 wherein said applique has a periphery defined by a first side edge, a second side edge, a distal edge and a proximal edge, said first side edge and said second side edge being substantially straight and tapered toward said proximal edge, said distal edge having a C-shape, said distal edge being adjoined to said first side edge and said second side edge, said proximal edge having a portion which is arched toward said distal edge and said proximal edge being adjoined to said first side edge and said second side edge.

15. A method of adorning a ceiling fan having a plurality of fan blades, each of said fan blades having a downwardly facing, visible surface, said method comprising:

providing an applique constructed of a flexible material, said applique having a front surface and a rear surface, said front surface having printed matter thereon, said rear surface having a pressure sensitive adhesive material coated thereon capable of releasably affixing said applique to at least one of said ceiling fan blades, said applique having a predetermined shape substantially corresponding to said downwardly facing, visible surface of said at least one fan blade; and affixing said applique onto at least one of said downwardly facing surfaces of said fan at least one blade.

16. The method as defined in claim 15 wherein said applique is laminated with a protective material.

17. The method as defined in claim 15 wherein said flexible material is a polyester material.

18. The method of claim 15 further comprising:

mounting said rear surface of said applique onto a release liner such that said release liner keeps said adhesive from contacting other objects prior to affixing said applique to said at least one of said fan blades; and removing said release liner from said applique prior to affixing said applique onto said at least one fan blade.

19. The invention as defined in claim 15 wherein said applique has a periphery defined by a first side edge, a second side edge, a distal end and a proximal edge, said first side edge and said second side edge being substantially straight and tapering toward said proximal edge, said distal edge being curved to meet said first side edge and said second side edge, said distal edge further including a pointed portion at the approximate center of said distal edge and said proximal edge having a curved portion meeting with said first side edge and said second side edge, respectively.

20. The invention as defined in claim 15 wherein said applique has a periphery defined by a first side edge, a second side edge, a distal end and a proximal edge, said first side edge and second side edge being substantially straight and tapered toward said proximal edge, said distal edge having curved portions meeting with said first side edge and said second side edge, respectively, said distal edge having a pointed portion at the approximate center thereof, and said proximal edge being substantially straight and adjoining said first and second side edges at substantially perpendicular angles, respectively.

21. The invention as defined in claim 15 wherein said applique has a periphery defined by a first side edge, a second side edge, a distal edge and a proximal edge, said first side edge and said second side edge being substantially straight and tapered toward said proximal edge, said distal edge having a C-shape, said distal edge being adjoined to said first side edge and said second side edge, said proximal edge having a portion which is arched toward said distal edge and said proximal edge being adjoined to said first side edge and said second side edge.

* * * * *